US009976346B2

(12) United States Patent
Ng

(10) Patent No.: US 9,976,346 B2
(45) Date of Patent: May 22, 2018

(54) ADJUSTABLE BOTTOM BAR FOR ROLLER BLIND

(71) Applicant: ZMC Metal Coating Inc., Woodbridge (CA)

(72) Inventor: Philip Ng, Thornhill (CA)

(73) Assignee: ZMC Metal Coating Inc., Woodbridge (CA)

( * ) Notice: Subject to any disclaimer, the term of this patent is extended or adjusted under 35 U.S.C. 154(b) by 0 days. days.

(21) Appl. No.: 15/341,903

(22) Filed: Nov. 2, 2016

(65) Prior Publication Data

US 2017/0138126 A1 May 18, 2017

Related U.S. Application Data

(60) Provisional application No. 62/255,670, filed on Nov. 16, 2015.

(51) Int. Cl.
*E06B 9/42* (2006.01)

(52) U.S. Cl.
CPC ..... *E06B 9/42* (2013.01)

(58) Field of Classification Search
CPC ..... E06B 9/42; E06B 9/62
See application file for complete search history.

(56) References Cited

U.S. PATENT DOCUMENTS 3,524,491 A * 8/1970 Olson ..... A47H 23/01 160/384
4,393,915 A * 7/1983 Olson ..... E06B 9/17046 160/384
4,452,294 A * 6/1984 Fukuchi ..... A47H 23/01 160/384
4,487,244 A * 12/1984 Olson ..... E06B 9/60 160/238
5,655,590 A * 8/1997 Bryant ..... E06B 9/382 160/168.1 R
6,098,698 A * 8/2000 King-Darr ..... E06B 9/54 160/23.1
2012/0097346 A1* 4/2012 Ng ..... E06B 9/388 160/264
2015/0292262 A1* 10/2015 Miller et al. ..... E06B 9/13 160/270
2016/0032646 A1* 2/2016 Fleischman ..... E06B 9/40 160/309
2016/0130869 A1* 5/2016 Cheng ..... E06B 9/42 160/309

FOREIGN PATENT DOCUMENTS

CA 2946023 * 5/2017

* cited by examiner

*Primary Examiner* — Blair M Johnson
(74) *Attorney, Agent, or Firm* — Honigman Miller Schwartz and Cohn LLP

(57) ABSTRACT

A bottom bar for a roller blind. The bottom bar has a longitudinal body with an upper surface having a longitudinal channel that is in communication with a generally hollow interior. The channel receives the lower end of the blind fabric to which is secured a stopper to hang the longitudinal body from the fabric. The bottom bar includes one or more spacers receivable within the generally hollow interior and between the stopper and the upper surface of the longitudinal body. The spacers increase the set-off between the stopper and the upper surface of the longitudinal body, thereby lifting the elevation of the longitudinal body relative to the roller tube.

5 Claims, 5 Drawing Sheets

ADJUSTABLE BOTTOM BAR FOR ROLLER BLIND

CROSS-REFERENCE TO RELATED APPLICATIONS

This U.S. patent application claims priority to U.S. Provisional Application 62/255,670 filed on Nov. 16, 2015 the disclosure of which is considered part of the disclosure of this application and is hereby incorporated by reference in its entirety.

FIELD

This invention generally relates to roller blinds, and in particular to an adjustable bottom bar for a roller blind.

BACKGROUND

Roller blinds are commonly mounted on windows for both residential and commercial applications. Roller blinds are typically fitted with a bottom bar that generally extends across the width of the blind material in order to both present a finished and pleasing termination of the end of the blind material, and to also provide added weight to help the material hang in a relatively taut configuration. In some instances bottom bars may also serve the added function of providing a structure which can be grasped in order to extend or retract the blind material from its roller.

For esthetic purposes, or on account of the overall width of the window to which a blind is to be secured, the blind may be comprised of two or more individual blinds that are mounted end to end. In such instances it is common for the roller tubes of the adjacent blinds to be connected such that a single drive mechanism can be operated in order to lower or retract both blinds simultaneously. Where two blinds are mounted end to end there is a desire to help ensure that the elevation of the bottom bars on the two adjacent roller blinds is the same so that when the blinds are deployed, or retracted, the two bottom bars will be horizontally aligned. For a variety of reasons, following installation the bottom bars of two (or more) such adjacent blinds are often not horizontally aligned. In those situations the installer is typically required to either adjust the winding of one of the blind fabrics upon the roller tube, or to disassemble one of the bottom bars, adjust the length of fabric and then reassemble the bottom bar upon the fabric to achieve horizontal alignment of the two bottom bars.

SUMMARY

The invention therefore provides a bottom bar for a roller blind of the type where blind fabric is received about a roller tube, the bottom bar comprising a longitudinal body having an upper surface with a longitudinal channel formed therein, said channel in communication with a generally hollow interior of the longitudinal body and having a width greater than the thickness of the blind fabric but less than the thickness of a stopper secured to the lower end of the blind fabric to permit the longitudinal body to be slid along the length of the blind fabric with the lower end of the blind fabric and the stopper received within the generally hollow interior of the longitudinal body to hang the longitudinal body from the fabric; and one or more spacers receivable within said generally hollow interior and between the stopper and the upper surface of the longitudinal body, said spacers increasing the set-off between the stopper and the upper surface of the longitudinal body, thereby lifting the elevation of the longitudinal body relative to the roller tube.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
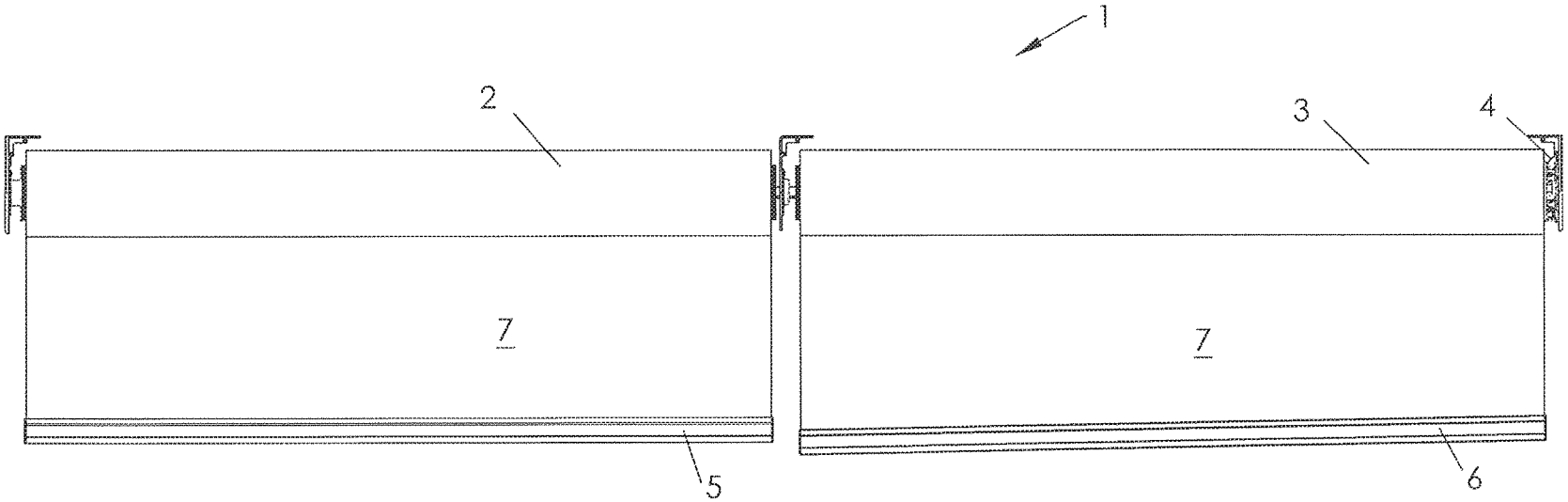
FIG. 1 is a side elevational view of a typical roller blind assembly comprised of two adjacent roller blinds, wherein their bottom bars are out of horizontal alignment.
Figure 2:
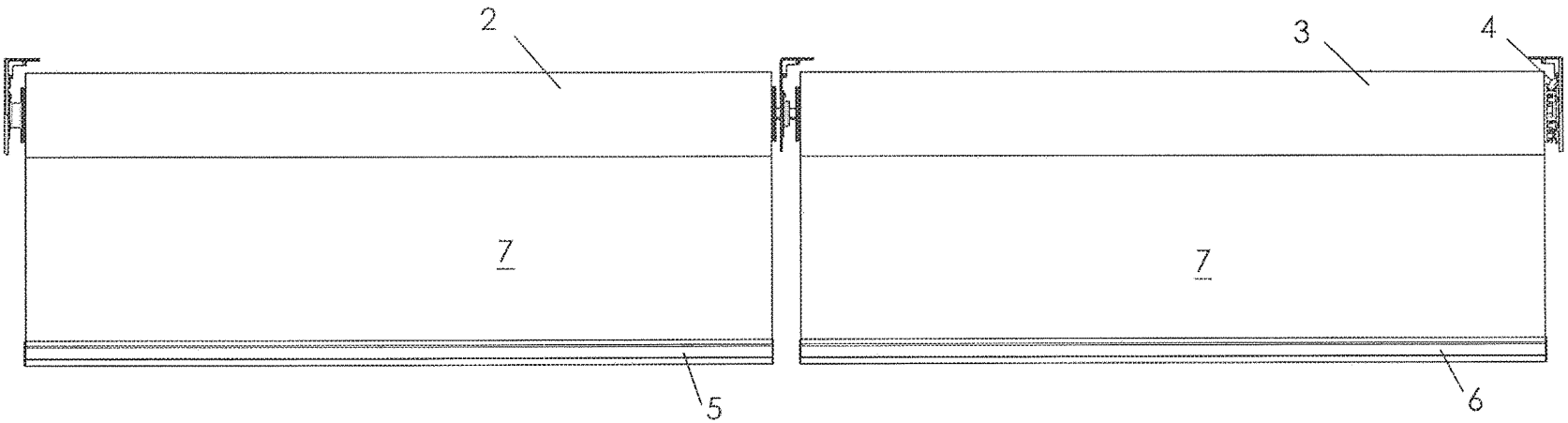
FIG. 2 is a view similar to FIG. 1 wherein the bottom bars have been horizontally aligned.
Figure 3:
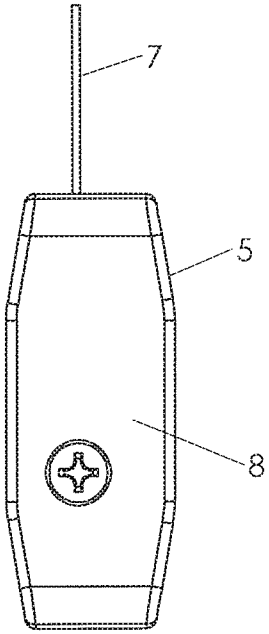
FIG. 3 is an end view of an adjustable bottom bar in accordance with an embodiment of the invention.

FIG. 1 illustrates a typical roller blind assembly 1 that is comprised of two adjacent roller blinds 2 and 3, respectively. The roller tubes for each of the roller blinds are mounted along the same horizontal axis and the blinds share a common drive assembly 4. In the embodiment shown in FIG. 1, the bottom bars 5 and 6 of roller blinds 2 and 3 are shown in a configuration where they are out of horizontal alignment, as is commonly the case following the installation of roller blind assembly 1. FIG. 2 is a view similar to FIG. 1, wherein the bottom bars have been horizontally aligned through the employment of the current invention. FIG. 3 illustrates the end of an adjustable bottom bar in accordance with an embodiment of the invention where the bottom bar is shown hanging from blind fabric 7 with its end enclosed by a trim cap 8.

Figure 4:
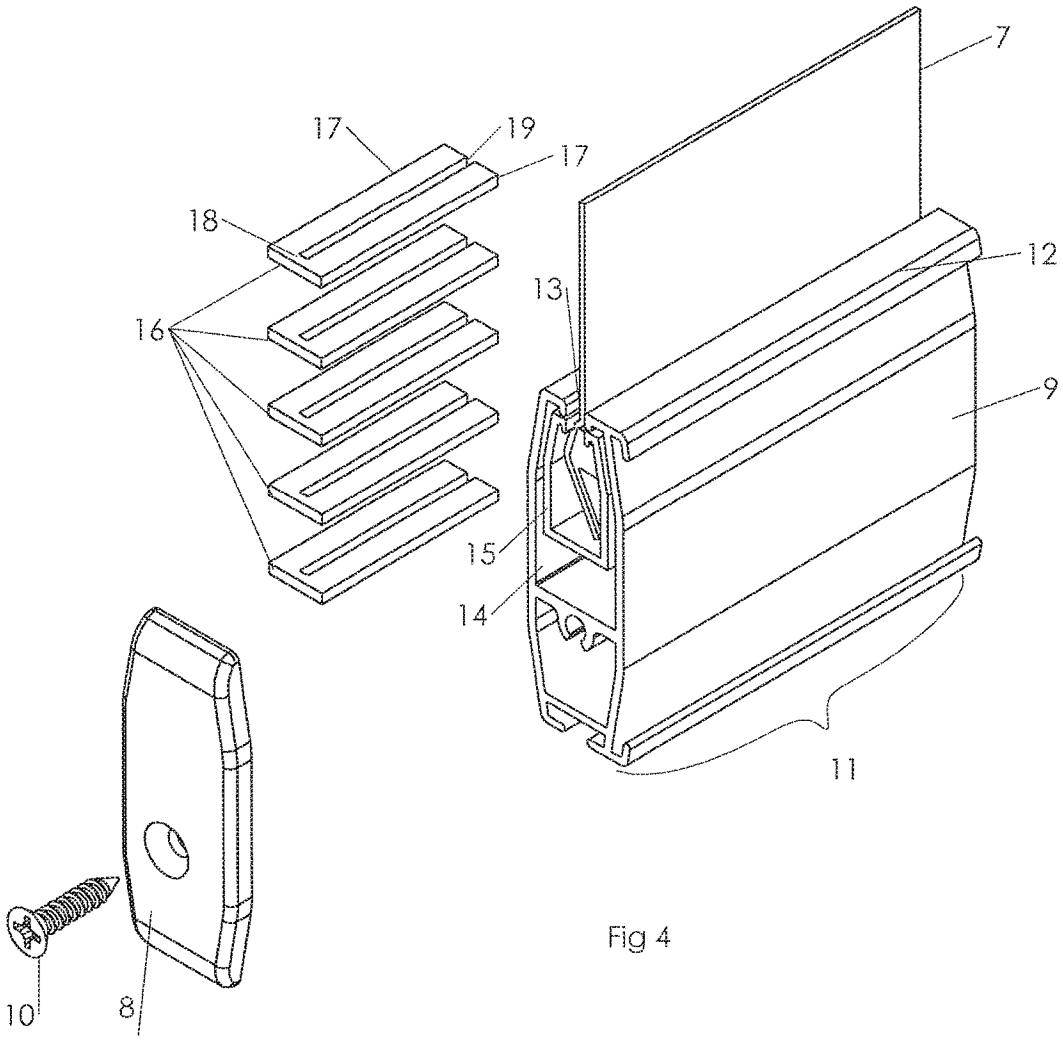
FIG. 4 is an exploded view of a portion of a bottom bar in accordance with an embodiment of the invention.
Figure 5:
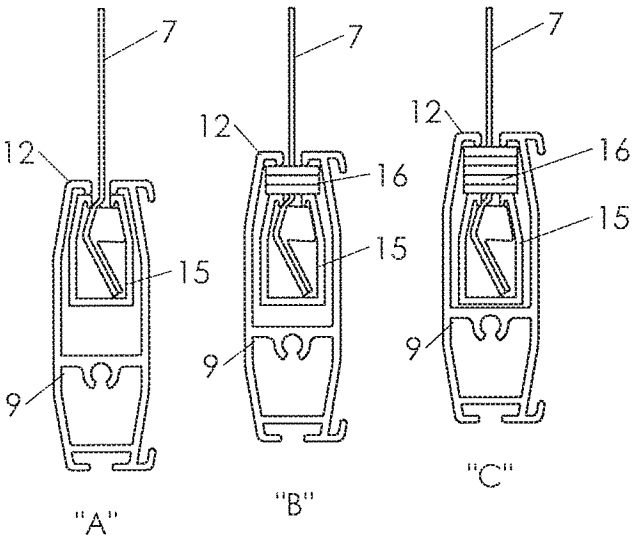
FIG. 5 is an end view of three different bottom bars, each of the bottom bars having their trim caps removed and each showing a different extent of vertical adjustment.

With reference specifically to FIGS. 4 and 5, there is depicted an embodiment of a bottom bar 9 (which may be either bottom bar 5 and/or bottom bar 6) illustrating adjustability in accordance with the invention. FIG. 4 illustrates a portion of bottom bar 9 having a trim cap 8 shown in an exploded position prior to being secured in place through screw or fastener 10. Bottom bar 9 includes a longitudinal body 11 having an upper surface 12 with a longitudinal channel 13 extending along the length thereof. Longitudinal body 11 has a generally hollow interior 14. Longitudinal channel 13 has a width that is greater than the thickness of blind fabric 7 to permit the blind fabric to pass through channel 13 into hollow interior 14. A stopper 15 is secured to the lower end of the blind fabric 7. The stopper is larger in width than longitudinal channel 13, permitting longitudinal body 11 to be slid along the length of blind fabric 7 with the lower end of the blind fabric and stopper 15 received within hollow interior 14, hanging the longitudinal body from the blind fabric.

In accordance with the invention, bottom bar 9 further includes one or more spacers 16 which are receivable within hollow interior 14. As shown more specifically in FIG. 5, spacers 16 are received about blind fabric 7 in a manner such that the spacers increase the set-off between stopper 15 and upper surface 12 of longitudinal body 11 to effectively lift the elevation of the longitudinal body relative to the roller tube of the roller blind.

To accomplish their functionality, in one embodiment on the invention spacers 16 are generally u-shaped having a pair of opposed legs 17 connected at one end by a bridge 18 such that legs 17 are separate by a channel 19. It will be appreciated that spacers of such a configuration can effectively be slid through the end of longitudinal body 11 with blind fabric 7 received within channel 19 such that the spacers are positioned between stopper 15 and upper surface 12 of the longitudinal body. In the embodiments shown in the attached drawings, spacers 16 are generally planer in nature such that they are stackable on top of one another, permitting spacers to be added or removed to effectively alter the elevation of the bottom bar relative to the roller tube. In FIG. 4, five spacers are indicated as being insertable into hollow interior 14 of the longitudinal body. It will, however, be appreciated that either none or any one of a number of individual spacers could be inserted about the blind fabric and within hollow interior 14 in order to achieve the desired elevational adjustment of the bottom bar.

The spacers 16 may be constructed from a wide variety of materials. For example, in some cases it may be desirable to add additional weight to the bottom bar to help hold the blind fabric in a tight or taut configuration. In such circumstances the spacers may be formed from steel or another metal. Spacer 16 may also be magnetic to enable multiple spacers to be held together in a single unit.

FIG. 5 depicts an end view of three different bottom bars with their trim caps removed and where each bottom bar depicts a different level of adjustment. In diagram "A" no spacers are inserted within the hollow interior of the longitudinal body such that the bottom bar is hung from blind fabric 7 through stopper 15 coming into contact with the underside of upper surface 12. Such a configuration is consistent with bottom bar 6 shown in FIG. 1. In diagram "B", three spacers 16 have been inserted into the hollow interior of bottom bar 9 and are located between the underside of upper surface 12 and stopper 15. In so doing, it will be appreciated that the spacers effectively raise the elevation of the depicted end of bottom bar 9 relative to the roller tube. Diagram "B" is shown with the bottom bar elevationally higher than that shown in diagram "A". Diagram "C" is similar to diagram "B", however, in this instance five spacers have been inserted to further increase the elevation of the depicted end of the bottom bar.

Although only one end of bottom bar 9 is shown in FIG. 5, the opposite or second end of the bottom bar may also have one or more spacers inserted. In most instances it is expected that the same number of spacers will be inserted into each end of the bottom bar, thereby effectively raising each end by the same amount. However, it will also be appreciated that in certain instances it may be desirable to raise one end of the bottom bar more than the other in order to achieve horizontal alignment or leveling of the bottom bar.

It will therefore be appreciated that from a thorough understanding of the invention there is provided a structure and a mechanism to permit an adjustment of the vertical position of the bottom bar, or where desired one end of the bottom bar.

It is to be understood that what has been described are the preferred embodiments of the invention. The scope of the claims should not be limited by the preferred embodiments set forth above, but should be given the broadest interpretation consistent with the description as a whole.

I claim:

1. A bottom bar for a roller blind of the type where blind fabric is received about a roller tube, the bottom bar comprising:

a longitudinal body having an upper surface with a longitudinal channel formed therein, said channel in communication with a generally hollow interior of the longitudinal body and having a width greater than the thickness of blind fabric to be received about the roller tube but less than the thickness of a stopper to be secured to the lower end of the blind fabric, thereby permitting the longitudinal body to be slid along the length of the blind fabric with the lower end of the blind fabric and the stopper receivable within the generally hollow interior of the longitudinal body to hang the longitudinal body from the fabric; and one or more spacers receivable within said generally hollow interior and between the stopper and the upper surface of the longitudinal body, said spacers increasing the relative distance between the stopper and the upper surface of the longitudinal body, thereby lifting the elevation of the longitudinal body relative to the roller tube, said spacers generally planer and stackable on top one another such that spacers can be added or removed to effectively alter the elevation of the bottom bar relative to the roller tube.

2. The bottom bar as claimed in claim 1 wherein said spacers are generally u-shaped having a pair of opposed legs connected at one end by a bridge and separated by a channel such that said spacers are receivable within said hollow interior of said longitudinal body through sliding said spacers into an end of the longitudinal body with blind fabric receivable within said channel in said spacers.

3. The bottom bar as claimed in claim 1 wherein said spacers are magnetic to enable multiple spacers to be held together.

4. The bottom bar as claimed in claim 1 wherein said longitudinal body has a first and a second end, one or more spacers received within each of said first and second ends to alter the elevation of said ends of said bottom bar relative to the roller tube.

5. The bottom bar as claimed in claim 3 including trim caps enclosing said first and second ends of said longitudinal body.

* * * * *